US009003714B2

(12) United States Patent
Vance

(10) Patent No.: US 9,003,714 B2
(45) Date of Patent: Apr. 14, 2015

(54) ROOF GUTTERING SYSTEMS AND BRACKETS

(71) Applicant: Douglas Jeffrey Vance, Bridge Creek (AU)

(72) Inventor: Douglas Jeffrey Vance, Bridge Creek (AU)

( * ) Notice: Subject to any disclaimer, the term of this patent is extended or adjusted under 35 U.S.C. 154(b) by 13 days.

(21) Appl. No.: 14/105,861

(22) Filed: Dec. 13, 2013

(65) Prior Publication Data

US 2014/0165477 A1 Jun. 19, 2014

(30) Foreign Application Priority Data

Dec. 14, 2012 (AU) ..... 2012905495

(51) Int. Cl.
*E04D 13/08* (2006.01)
*E04D 13/064* (2006.01)

(52) U.S. Cl.
CPC ..... *E04D 13/064* (2013.01)

(58) Field of Classification Search
CPC . E04D 13/076; E04D 13/064; E04D 13/0645; E04D 13/0725; E04D 2013/086; E04D 2013/0413; E04B 1/92
USPC ..... 52/11–16, 741.3, 198–200, 58, 95, 97; 210/153–154, 162–164, 473–474, 210/459–402, 510.1, 477; 404/2, 4; 405/119
See application file for complete search history.

(56) References Cited

U.S. PATENT DOCUMENTS 316,578 A * 4/1885 Schumann et al. ..... 210/162
2,533,402 A 12/1950 Schmitz
2,669,197 A * 2/1954 Duzer ..... 210/162
2,807,368 A * 9/1957 Blau ..... 210/463
2,828,022 A * 3/1958 Morrison ..... 210/459
2,875,712 A * 3/1959 Blau ..... 210/154
3,507,396 A * 4/1970 Homa ..... 210/477
5,107,635 A * 4/1992 Carpenter ..... 52/12
5,409,602 A * 4/1995 Sorenson ..... 210/162
5,535,554 A * 7/1996 Harris Jr. ..... 52/12
5,649,681 A * 7/1997 Faye ..... 248/48.1
5,836,716 A * 11/1998 Johnson et al. ..... 405/43
RE36,343 E * 10/1999 Silva ..... 210/460
5,960,590 A * 10/1999 Hutchison ..... 52/11
6,035,580 A * 3/2000 Carter ..... 52/12
6,193,880 B1 * 2/2001 Bergeron ..... 210/162
6,293,054 B1 * 9/2001 Cangialosi ..... 52/12
6,729,795 B2 * 5/2004 Dahowski et al. ..... 404/4
6,951,081 B2 * 10/2005 Bonshor ..... 52/97
7,200,969 B2 * 4/2007 Rotter ..... 52/12
7,544,288 B1 * 6/2009 Cook ..... 210/162
7,740,755 B2 6/2010 Wilson
7,752,811 B1 7/2010 Pavlansky
7,871,109 B1 * 1/2011 McKinnon et al. ..... 285/12
8,646,217 B2 2/2014 Ratajac
2005/0034376 A1 * 2/2005 Pourdeyhimi et al. ..... 52/11
2006/0278573 A1 * 12/2006 Robinson ..... 210/460
2008/0256880 A1 * 10/2008 Nurenberg et al. ..... 52/198
2011/0283631 A1 * 11/2011 Bath et al. ..... 52/12

* cited by examiner

*Primary Examiner* — Beth Stephan

(57) ABSTRACT

In one preferred form of the present invention there is provided a roof rain gutter system. The roof rain gutter system comprises a drainage pipe for being positioned within and extending along a gutter. A coarse heavy filler material is placed on top of the drainage pipe for allowing the passage of rain water. A rain guttering component is positioned above a drop outlet of the gutter for directing water flowing through the drainage pipe downwardly into the drop outlet. The rain guttering component is adapted to surround the drop outlet to assist with preventing the passage of coarse heavy filler material through the drop outlet.

11 Claims, 21 Drawing Sheets

ROOF GUTTERING SYSTEMS AND BRACKETS

CROSS-REFERENCE TO RELATED APPLICATIONS

This application claims the right of priority under 35 USC §119 based on Australian Patent Application No. 2012905495, filed 14 Dec. 2012, which is incorporated by reference herein in its entirety.

FIELD OF THE INVENTION

In preferred forms the present invention relates to roof guttering stone filter systems.

BACKGROUND TO THE INVENTION

The problem of roof gutters accumulating and blocking up with debris is well known. Many prior art devices and methods exist which attempt to overcome this inherent problem with roof gutters, but no single solution to date has been adaptable to all situations or without having some other disadvantage or undesirable attribute.

Although most gutters are a simple U shaped design there are many variations of their profile, size, and attaching methods as well as a variety of roof cladding materials that also have many different profiles. Then there is also different roof pitches and gutter to roof alignment, and variations in the extent that the roofing iron or tiles extend across the gutters. Because of all these variations one significant problem of gutter protection devices has been their adaptability or lack thereof.

Where gutters are mounted with their outer edge above the roof edge, which is common, any of the prior art gutter protection devices placed in the gutter, such as screens, foam filters or bristle type gutter guards, are all unable to fill the space without creating or having ridges, depressions, flat sections or other similar features that hold and accumulate debris. U.S. Pat. No. 6,594,956 illustrates a mesh screen placed within a gutter that results in a debris trapping ridge between itself and the roof U.S. Pat. No. 5,257,482 shows a screen attached under roof shingles and to the outer edge of a gutter resulting in a dip in the screen that can accumulate leaf and other debris. Only screens that are attached between the gutter edge and the roof have been able to eliminate this problem. This however requires the fixing of the screen to the roof surface or insertion of the edge of the screen under tiles. This is a tedious and thus expensive task, usually requiring the screen to be shaped to fit the roof profile and then screwed and/or glued on. These screens are known to detach or sag over time especially if they start to accumulate any debris, have any heavy animals walk on them or have branches land on them. U.S. Pat. No. 5,729,931 illustrates a screen attached between the gutter edge and the roof that utilizes a pre profiled member for the screen to attach to for use with corrugated roofs. This is a more secure means of attaching but it requires a specialized profile for each type of roof profile and even then it can be problem for the two to match as the profile of the roof often varies. Also there is the extra complexity with fitting of the screens around the gutter corners.

A way that is used to overcome the above problems is by mounting the gutters lower so that the protection devices are below the roof edge. Gutter covers such as illustrated in U.S. Pat. No. 7,730,672 that uses surface tension as a means to separate debris from water is one example. It is however not practical or possible to reposition many existing gutters and may often not be considered for new installations for aesthetic reasons as many gutters are designed to visually cover the edge of the roof. Gutters that are positioned lower for the above reason are usually a specialized unit with an integrated cover arrangement included, which adds to their cost.

Other major issues with gutter protection devices are their effectiveness at separating debris from water and their maintenance requirements. Screens let through anything that is smaller than the size of their apertures and block up with debris that only partly fits through. If screens are too fine they can sheet the water off even if they are not blocked. Helmet devices that rely on the water tension principle do let an amount of debris through. This builds up and blocks the gutter over time, the helmet cover then prevents it being cleaning out. Screens also let enough debris through to block the gutters over time and prevent or make it very difficult to clean them out. Foam filters provide a good filtering effect but they block with dirt and require cleaning or replacing quite regularly. They need to be especially shaped to match a particular gutter and need to be cut on site to fit in gutters with internal brackets, all of which adds to their cost. They also accumulate debris on top and have antibacterial and fire retardants which may not be ideal for drinking water supplies.

Prior art gutter protection devices generally have one or more of the following disadvantages.

(i) Specialized and expensive—gutters with integrated cover device and tipping gutters.
(ii) Not adaptable—suitable for only one size or type of gutter and/or roof type—requires a particular and consistent gutter to roof alignment.
(iii) Fits poorly and/or works poorly—the less expensive mesh and similar screens that are positioned within the gutter.
(iv) Accumulates debris—has an inherent debris trapping configuration.
(v) Blocks up—apertures of the devices clog with debris.
(vi) Restricted capacity—apertures are too small causing water sheet off over the side instead of passing through into the gutter.
(vii) Debris of sufficient quantity passes through the protection device to build up and block the gutter and also cause poor quality water for storage tanks
(viii) Restricts or prevents the gutter from being cleaned out.
(ix) Sags to form depressions that hold debris.
(x) Detaches—especially when glued on to roof.
(xi) Easily damaged.
(xii) Expensive parts.
(xiii) Expensive to install.
(xiv) Expensive to repair.
(xv) Expensive to replace.
(xvi) High maintenance—requires regular cleaning or removal of debris.
(xvii) Not durable—short life span.
(xviii) Contaminates the water supply as they deteriorate.
(xix) Contaminates water with antibacterial, fire-retardant or other chemicals.
(xx) Has moving parts—complicated and expensive—tipping gutters
(xxi) Collapse from the weight of debris.
(xxii) Not fire proof.
(xxiii) Does not prevent fire embers or vermin from entering roof cavity.

It is against this background and the problems and difficulties associated therewith that the present invention has been developed.

In addition the present invention has been developed with the aim of limiting the accumulation of debris and other material in roof gutters and provide an effective long lasting filter for an improvement in water quality going into storage tanks

SUMMARY OF THE INVENTION

According to a first aspect of preferred embodiments herein described there is provided a roof rain gutter system comprising: a drainage pipe for being positioned within and extending along a gutter; a coarse heavy filler material for being placed on top of the drainage pipe for allowing the passage of rain water; and a rain guttering component for being positioned above a drop outlet of the gutter for directing water flowing through the drainage pipe downwardly into the drop outlet; the rain guttering component being adapted to surround the drop outlet to assist with preventing the passage of coarse heavy filler material through the drop outlet.

Preferably the roof rain gutter system includes a bracket arrangement for supporting the gutter from underneath to allow the gutter to securely support the weight of the coarse heavy filler material.

Preferably the bracket arrangement comprises a bracket spaced approximately every 1 m along the gutter.

Preferably brackets are retrofitted by being fastened through the facia below the gutter.

Preferably the coarse heavy filter material comprises coarse construction aggregate.

Preferably the aggregate is crushed stone. Preferably the aggregate is good hard stone, clean without any sand or rock dust and of a consistent size. Preferably the aggregate is drainage aggregate. The aggregate may be crushed stone or river pebbles 7 mm to 14 mm.

Preferably larger stones are used at the bottom and a smaller stone are used on top.

Preferably the drainage pipe comprises conventional slotted corrugated drainage pipe.

According to a second aspect of preferred embodiments herein described there is provided a method of providing a roof rain guttering system comprising: positioning a drainage pipe in a gutter; positioning a rain guttering component above a drop outlet of the gutter; the rain guttering component for allowing the discharge of water from the drainage pipe; filling the gutter with coarse heavy filler material; and positioning brackets below the gutter to securely support the weight of the coarse heavy filler material.

Preferably the method includes spacing brackets approximately every 1 m along the gutter.

Preferably the method includes retrofitting brackets through the facia below the gutter.

Preferably the coarse heavy filter material comprises coarse drainage aggregate.

Preferably the aggregate is 7 mm to 14 mm crushed stone or river pebbles.

Preferably the drainage pipe comprises conventional slotted corrugated drainage pipe.

According to a third aspect of preferred embodiments herein described there is provided a roof rain gutter component for a drop outlet of a gutter, the component comprising: a body having a first fluid port and a second fluid port; the first fluid port of the body for connection to a drainage pipe on one or both sides that is positioned within and extending along the gutter; and the second fluid port of the body being adapted to be positioned over the drop outlet of the gutter for directing water downwardly through the drop outlet.

Preferably the body includes a cover portion for preventing the passage of coarse heavy filler material through the drop outlet.

Preferably the roof rain gutter component as claimed includes a base portion adapted to sit relatively flush on the portion of the gutter surrounding the drop outlet.

In one embodiment the base portion includes a plurality of drainage vents for allowing the drainage of water into the drop outlet from adjacent the periphery of the second fluid port. In another embodiment there are no drainage vents with the system making use of a slight gap between the base portion and bottom of the gutter upon which the base portion rests.

Preferably the base portion defines the opening of the second fluid port by providing a flange portion therearound.

Preferably the first fluid port is adapted to be connected to a drainage pipe extending along the gutter.

Preferably the first fluid port provides two opposite openings for allowing connection to a drainage pipe on either side.

According to a fourth aspect of preferred embodiments herein described there is provided a bracket comprising: a first portion for substantially vertical mounting to a foundation and a second portion for providing a substantially horizontal support, the first portion and the second portion being formed from a single continuous rod member that is looped over to provide the first portion with an aperture for receiving a fastener.

According to a fifth aspect of preferred embodiments herein described there is provided a bracket comprising a first portion for substantially vertical mounting to a foundation, a second portion for providing a substantially horizontal support, and an extension for holding the upper lip of the gutter.

Preferably the extension is a removable component of the bracket.

Preferably the extension is sized to fit within the lip of the gutter and securely hold the gutter in position on the bracket.

According to a sixth aspect of preferred embodiments herein described there is provided a bracket comprising a first portion for substantially vertical mounting to a foundation, a second portion extending away from an upper end of the first portion, and a third portion for supporting a gutter from below, wherein the second portion includes a removable extension for holding the upper lip of the gutter.

According to a seventh aspect of preferred embodiments herein described there is provided a bracket comprising: a first portion for substantially vertical mounting to a foundation and a second portion for providing a substantially horizontal support, the first portion and the second portion being formed from sheet material that is bent to provide the bracket.

Preferably two portions are overlapped to provide horizontal and vertical flanges, a portion of the horizontal flange being overlapped with the vertical flange at an opening for receiving a bolt.

Preferably two portions are bent to provide two vertical flanges on either side, the vertical flanges being further bent to provide a central horizontal flange portion.

According to a eighth aspect of preferred embodiments herein described there is provided a bracket comprising a first portion for substantially vertical mounting to a foundation, a second portion for providing a substantially horizontal support and a removable brace portion extending between the first portion and the second portion.

Preferably the brace portion includes a body portion having a first end portion and a second opposite end portion, the first end portion being adapted to extend through the first portion and the second end portion being adapted to extend through the second portion.

Preferably the first end portion and the second end portion include corresponding distal surfaces adapted to lie flush with the outer surface of the respective first and second portions.

Embodiments of the present invention provide a bracket comprising: a first portion for substantially vertical mounting to a foundation and a second portion for providing a substantially horizontal support, the first portion and the second portion being formed from a single continuous rod member that is looped over to provide the first portion with an aperture for receiving a fastener.

Embodiments of the present invention provide a bracket comprising a first portion for substantially vertical mounting to a foundation, a second portion extending away from an upper end of the first portion, the second portion for holding an upper portion of the gutter.

Embodiments of the present invention provide a bracket comprising: a first portion for substantially vertical mounting to a foundation and a second portion for providing a substantially horizontal support, the first portion and the second portion being formed from sheet material that is bent to provide the bracket.

Embodiments of the present invention provide a bracket comprising a first portion for substantially vertical mounting to a foundation, a second portion for providing a substantially horizontal support and a removable brace portion extending between the first portion and the second portion.

It is to be recognised that other aspects, preferred forms and advantages of the present invention will be apparent from the present specification including the detailed description drawings and claims.

BRIEF DESCRIPTION OF DRAWINGS

In order to facilitate a better understanding of the present invention, several preferred embodiments will now be described with reference to the accompanying drawings detailed in drawings pages 1 to 22.

DETAILED DESCRIPTION OF THE EMBODIMENTS

It is to be appreciated that each of the embodiments is specifically described and that the present invention is not to be construed as being limited to any specific feature or element of any one of the embodiments. Neither is the present invention to be construed as being limited to any feature of a number of the embodiments or variations described in relation to the embodiments.

Figure 1A:
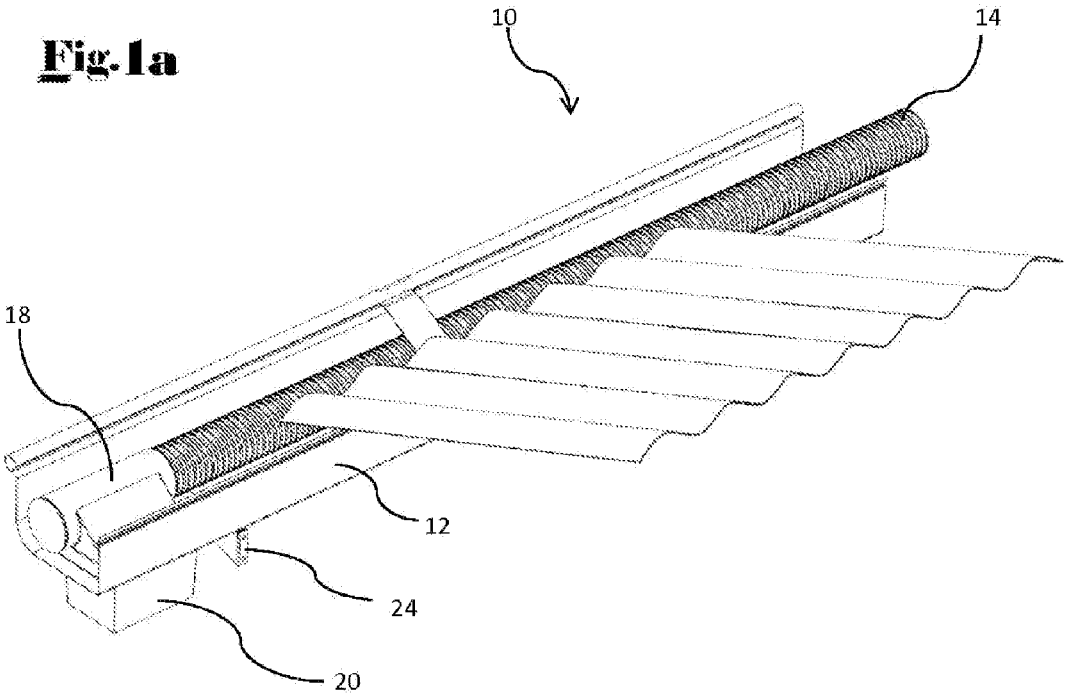
FIGS. 1*a*-1*b* show a roof rain gutter system according to a first embodiment of the present invention.
Figure 1B:
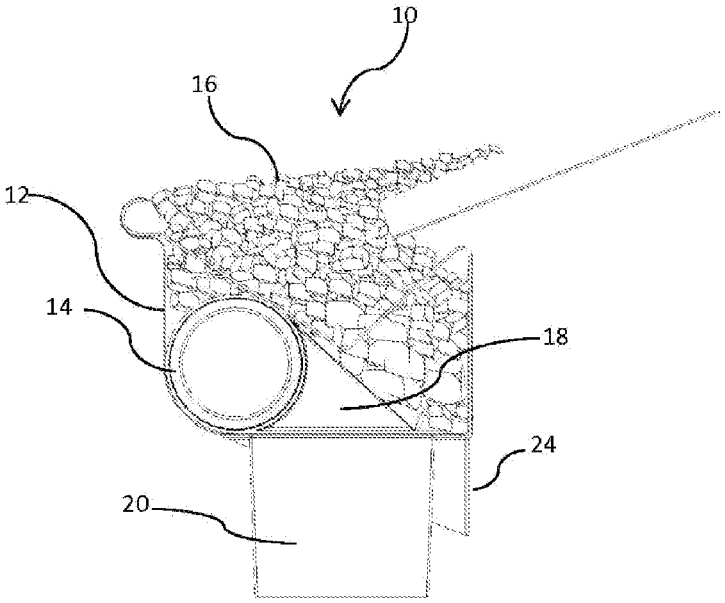
Figure 2:
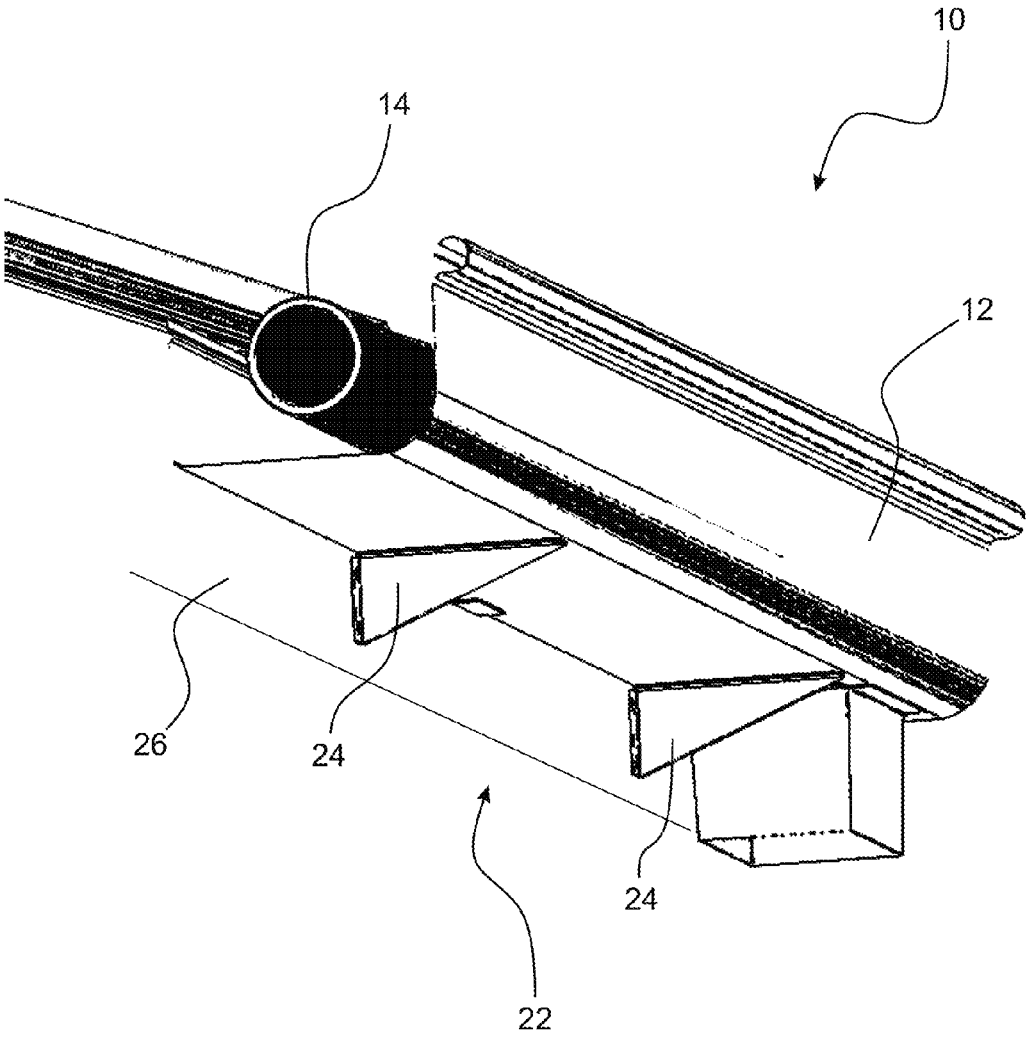
FIG. 2 shows a roof rain gutter system according to a first embodiment of the present invention.

Referring to FIGS. 1*a*-1*b* and 2 there is shown a roof rain gutter system 10 according to a first preferred embodiment of the present invention. The roof rain gutter system 10 is advantageously retrofitted to an existing gutter 12.

The roof rain gutter system 10 includes a drainage pipe 14 that is positioned within and extends along the gutter 12. A coarse heavy filler material 16 in the form of crushed stone is placed on top of the drainage pipe 14 and allows the passage of rain water into the drainage pipe. In addition the coarse heavy filler material 16 assists with holding the drainage pipe 14 in position.

In the system 10, a rain guttering component 18 is positioned above a drop outlet 20 of the gutter 12. The rain guttering component 18 is configured to direct water flowing through the drainage pipe 14 downwardly into the drop outlet 20. Advantageously the rain guttering component 18 is adapted to surround the drop outlet 20 to prevent the passage of coarse heavy filler material 16 through the drop outlet 20.

The weight of the coarse heavy filler material 16 is supported in the retrofit with the use of a bracket arrangement 22 shown in FIG. 2. In the embodiment, the bracket arrangement 22 comprises brackets 24 spaced approximately every 1 m along the gutter to support the gutter from underneath. The brackets 24 are retrofitted by being fastened through the facia 26 below the gutter 12.

The coarse heavy filler material 16 is provided in the form of coarse construction aggregate. The aggregate 16 is preferably large enough to resist the flow of fluid and provide advantageous drainage into the drainage pipe 14. The drainage pipe 14 comprises corrugated drainage pipe.

The system 10 is considered to provide an advantageous filter system where conventional drainage pipe can be advantageously accommodated in gutter systems of different sizing. The drainage pipe 14 is smaller in cross section than the gutter with the coarse heavy filler material 16 filling the remaining space on one or both sides of the gutter 12. The functionality and adaptability of the system 10 is considered to provide several commercial advantages over existing systems such as foam filter systems.

It is considered that the use of two or three different drainage pipe sizes is suitable for the most commonly used sizes of roof gutter. The stone aggregate filling the gutter space creates a three dimensional filter before rain water is carried by the drainage pipe and is directed through the drop outlet.

In addition the system advantageously allows for retrofitting to gutters having internal brackets. This is achieved by the drainage pipe 14 being threaded underneath the internal brackets before the coarse heavy filler material 16 is applied. The system 10 also allows for fitting into gutters where the roof partly extends over the gutter opening which is one problem of several existing systems.

The coarse heavy filler material provides a relatively flat surface without relatively large recesses that would otherwise accumulate leaf material. The system 10 is considered to assist with preventing leaves and other debris from collecting in the top of the gutter 12.

The use of the coarse heavy filler material 16 also serves to protect the drainage pipe 14 from exposure to the sun and the weight of the coarse heavy filler material 16 serves to assist with securing the drainage pipe 14 in position.

The use of coarse heavy filler material 16 may also be of benefit in a bush fire situation. Firstly by preventing the accumulation of leaf material and secondly, to a lesser degree, by protecting the plastic drainage pipe itself. In addition, with stones, they assist with preventing embers from entering the roof cavity as they bridge the gap between the gutter and roof.

Figure 3:
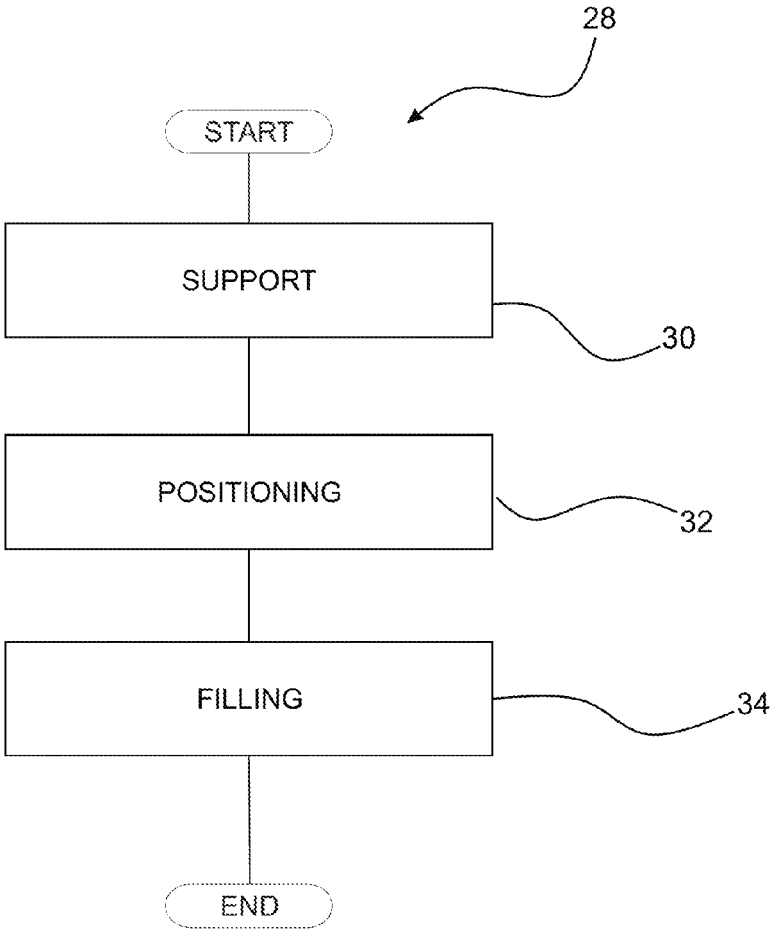
FIG. 3 illustrates a method of installation of a roof rain gutter system.

A method 28 of installation of the roof rain gutter system 10 is illustrated in FIG. 3. At block 30, the method 28 includes fitting the brackets 24 for supporting the gutter 12. At block 32 the method 28 includes positioning the drainage pipe 14 in the gutter 12 and positioning the rain guttering component 18 above a drop outlet 20 of the gutter 12. At block 34 the method includes filling the gutter 12 with the coarse heavy filler material 16.

In some instances fasteners in the form of tek screws are used to hold the drainage pipe and fittings together before placement of the stones. Other fittings that may be needed for the drainage pipe include joiners, right angle bends and end plugs.

Figure 4:
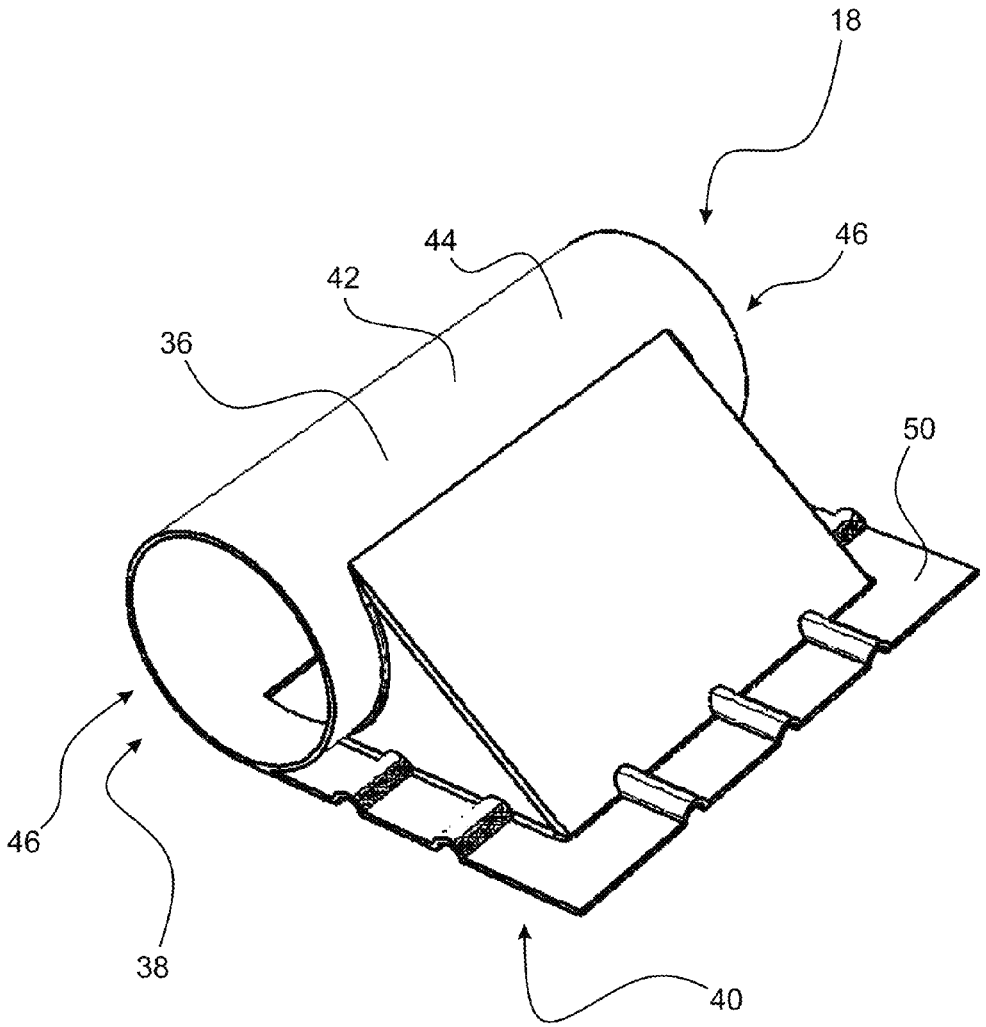
FIG. 4 shows a form of a roof rain gutter component.
Figure 5:
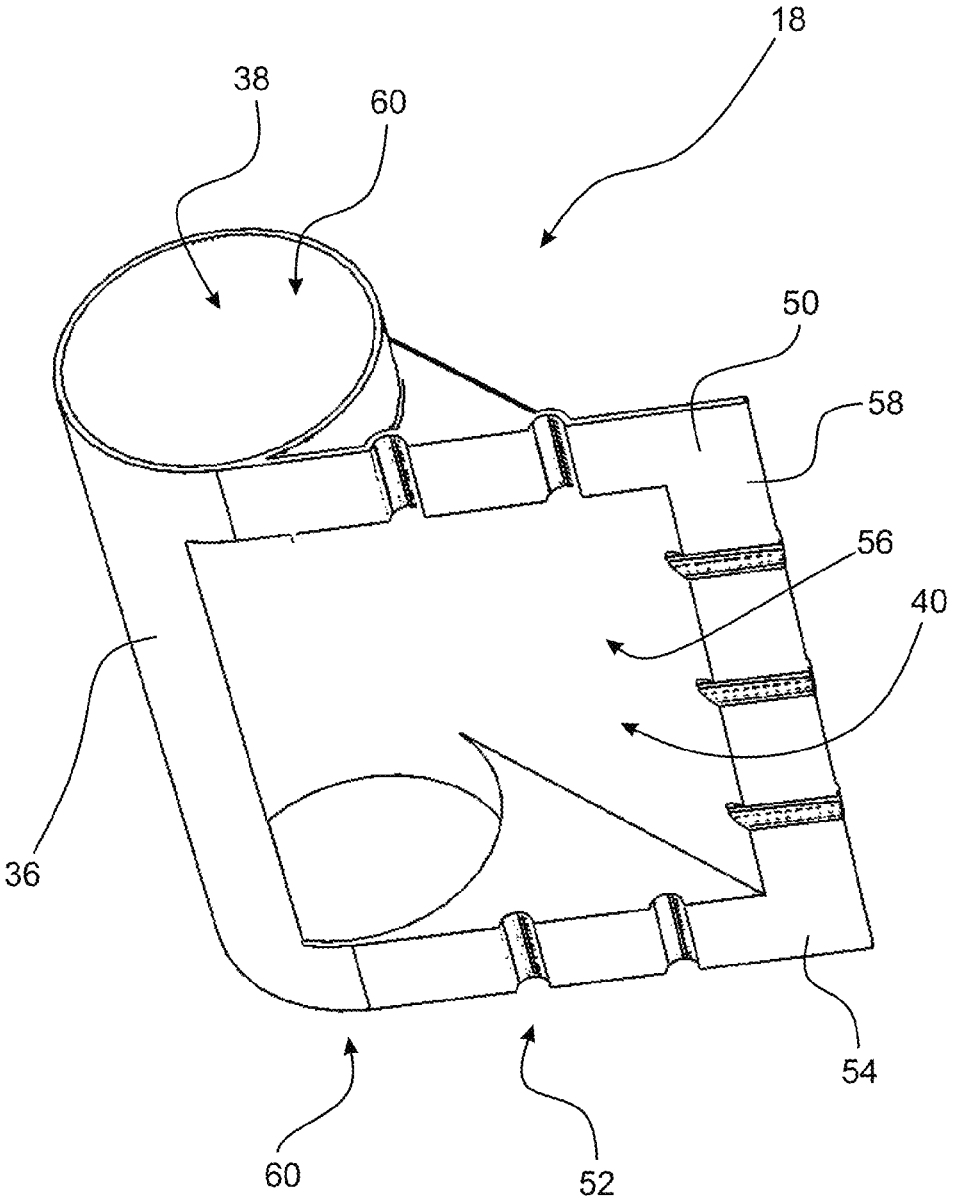
FIG. 5 shows a form of a roof rain gutter component.

The form of the roof rain gutter component 18 is highlighted in FIGS. 4 and 5. As shown, the roof rain gutter component 18 comprises a body 36 providing a first fluid port 38 and a second fluid port 40. The first fluid port 38 of the body 36 is provided for receiving water flowing along the gutter 12 in the drainage pipe 14. The second fluid port 40 of the body 36 is adapted to be positioned over the drop outlet 20.

As shown the first fluid port 38 is arranged at about 90 degrees to the second fluid port 40. The portion 42 of the body 36 between the first fluid port 38 the second fluid port 40 provides a cover portion 44 for preventing the passage of coarse heavy filler material 16 through the drop outlet 20.

Figure 6:
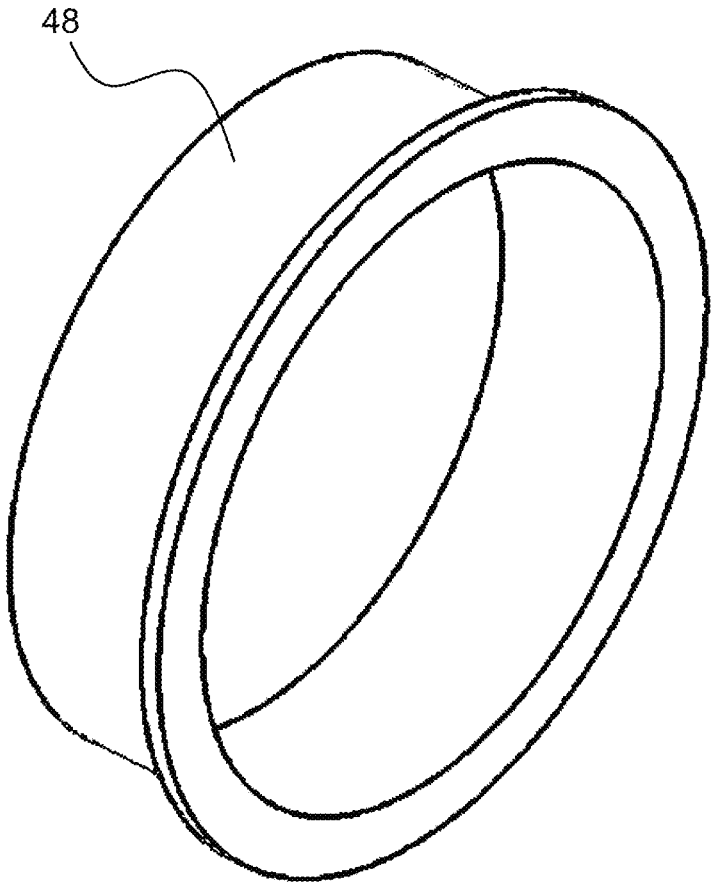
FIG. 6 shows a cover portion.

The first fluid port 38 is arranged as channel open at both ends 46. Notably a cover portion 48, shown in FIG. 6, can be used to close one of the ends 46 depending on the required configuration. The rain gutter component 18 can advantageously be used as a connector between two discharge pipes 14 either side of a drop outlet or as a terminating piece (see FIG. 1*a*).

Referring to FIGS. 4 and 5 the rain gutter component 18 includes a base portion 50 adapted to sit relatively flush on the portion of the gutter 12 surrounding the drop outlet 20. The base portion 50 includes a plurality of drainage vents 52 on its underside 54 for allowing the drainage of water into the drop outlet 20. When the first fluid port 38 is connected to the drainage pipe 14 some water may accumulate in the gutter below the drainage pipe 14. The drainage vents 52 advantageously allow drainage from around the periphery of the base portion 50. As would be apparent the base portion 50 defines the opening 56 of the second fluid port 40 by providing a flange portion 58 therearound.

The form of the body 36 provides the first fluid port 38 with two opposite openings 60 for allowing connection to a drainage pipe on either side. Each opening 60 of the first fluid port 38 is adapted to connect to drainage pipe extending along the gutter 12 or alternatively, be closed by the closure 48.

Figure 7:
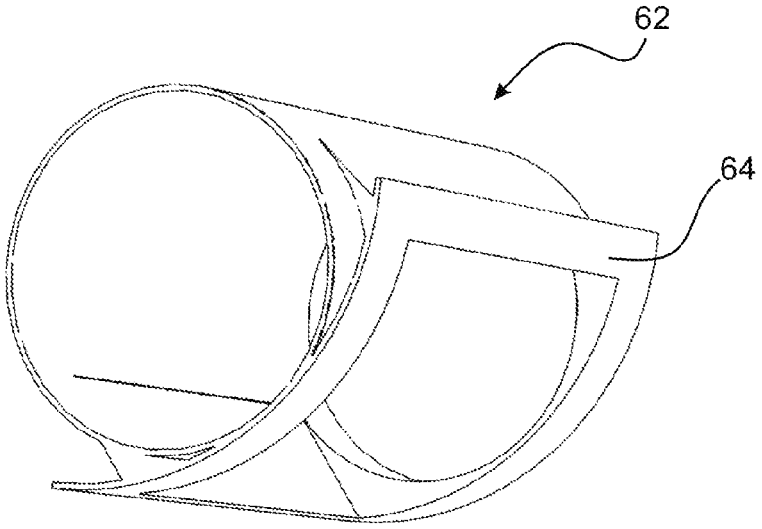
FIG. 7 illustrates a rain guttering component for a curved gutter.

FIG. 7 illustrates a rain guttering component 62 for a curved gutter. The guttering component 62 advantageously includes a curved base portion 64 for positioning over a curved opening of a corresponding drop outlet.

Figure 8:
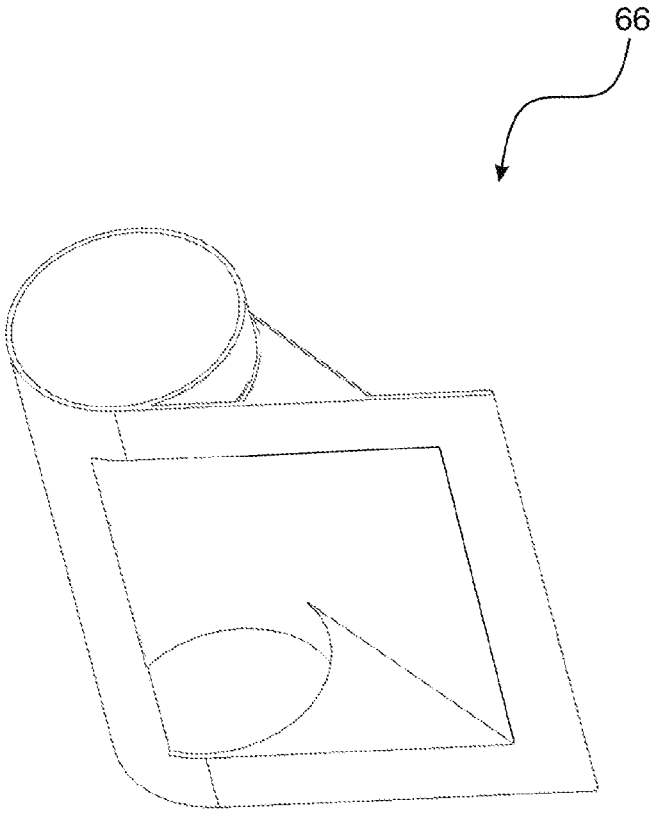
FIG. 8 illustrates a rain guttering component according to a further embodiment.

FIG. 8 illustrates another possible rain guttering component 66 according to a further embodiment. Notably the rain guttering components 62, 66 shown in FIGS. 7 and 8 do not include drainage vents on their bottom surfaces. Most guttering surfaces have been seen to include imperfections that allow for some drainage from beneath the drainage pipe.

Figure 9:
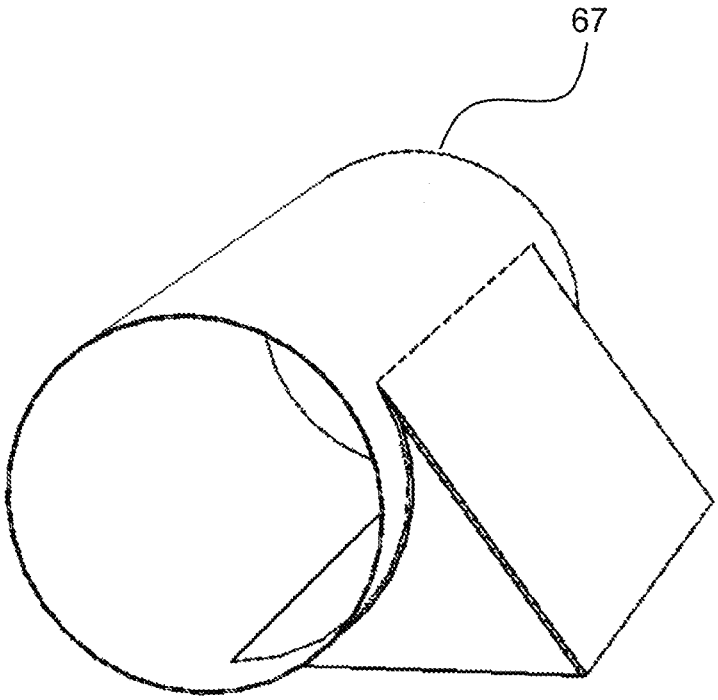
FIG. 9 illustrates a rain guttering component having no lower flange.

FIG. 9 illustrates a rain guttering component 67 having no lower flange. As would be apparent, half circular components could be made without a flange as well.

In practice, the drainage pipe 14 and the coarse heavy filler material 16 may be purchased separately. The provision of the roof rain gutter component 18 and brackets 24 may be provided as a kit for providing the system 10.

Figure 10:
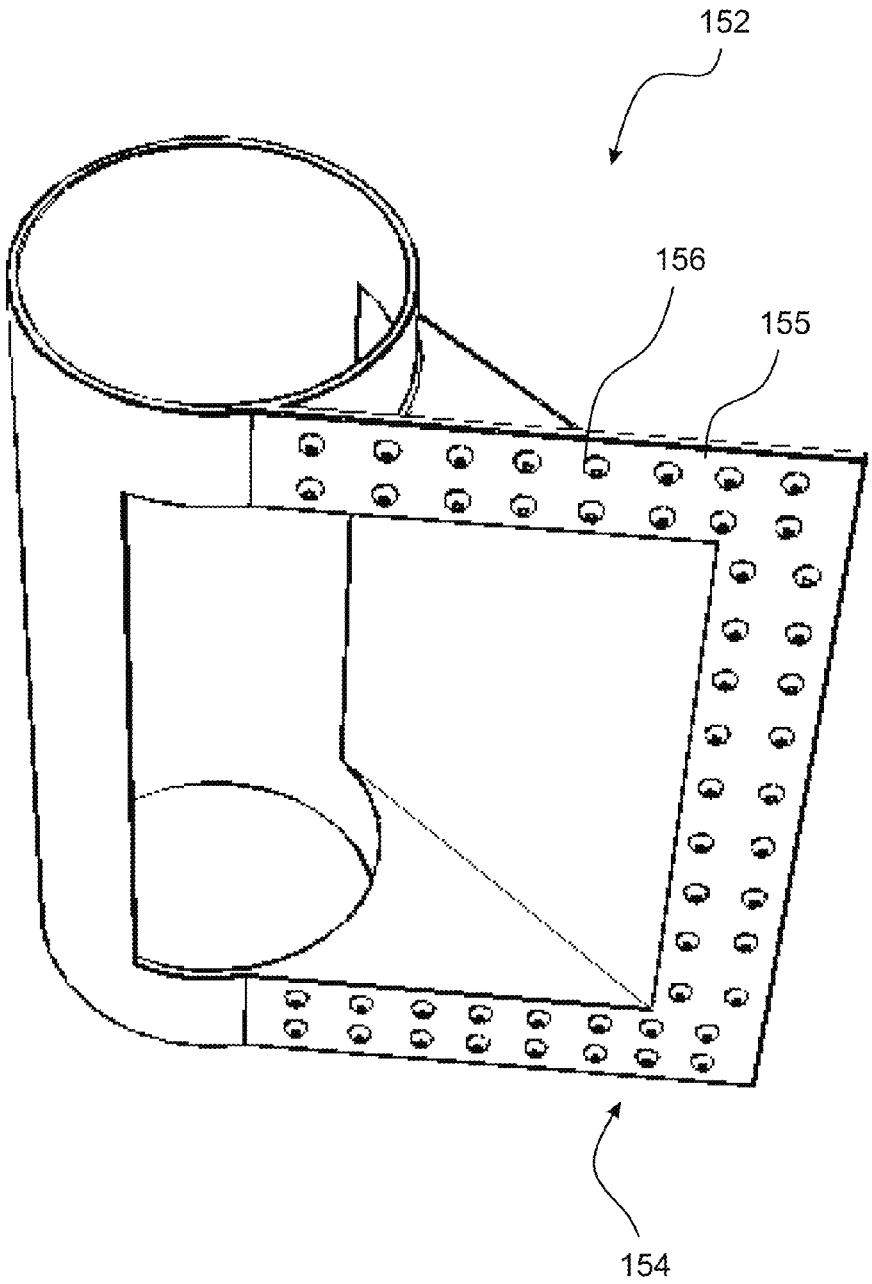
FIG. 10 illustrates a rain guttering component according to a further embodiment.

FIG. 10 illustrates a rain guttering component 152 according to a further embodiment. The rain gutter component 152 provides positive gap 154 for the passage of water underneath the flange 155 to downspout fitting using a number of protrusions 156. As shown the protrusions 156 lift the flange 155 up by the thickness of the protrusions 156. It is considered that this design advantageously provides for the passage of water underneath the substantial majority of the entire flange area and can be advantageously manufactured.

Figure 11:
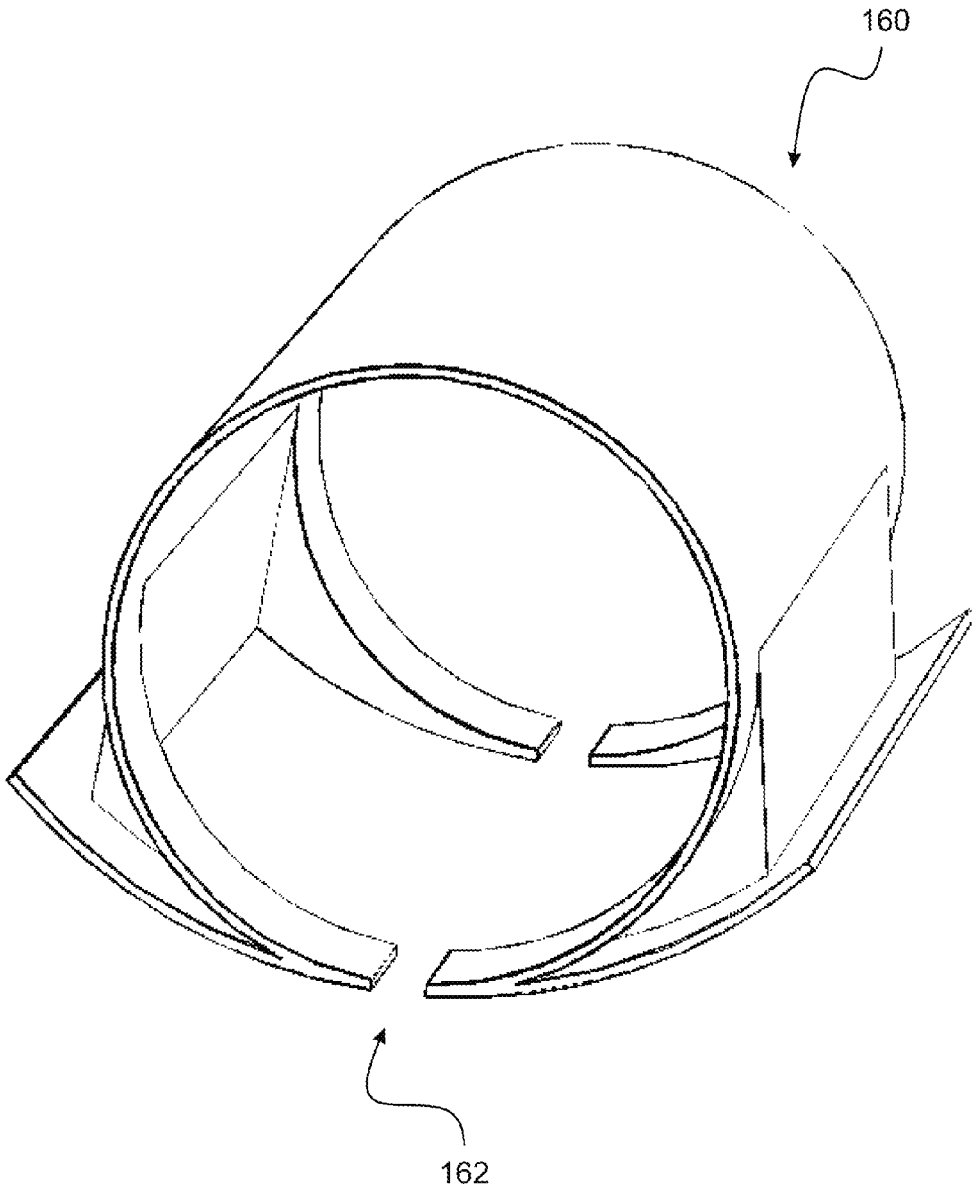
FIG. 11 illustrates a component according to a further embodiment.

Components for circular gutters could also have such protrusions. Nonetheless a component 160 forming another preferred embodiment is shown in FIG. 11. The component 160 of FIG. 11 does not result in the drainage pipe being lifted up by protrusions. As shown a channel 162 is formed in bottom section of the fitting. If the fitting had a cap, the cap could be cut as well.

The roof rain gutter component 18 and the roof rain gutter system 10 individually and as a whole are considered to be advantageous. The applicant has also designed a number of advantageously brackets described below.

Figure 12:
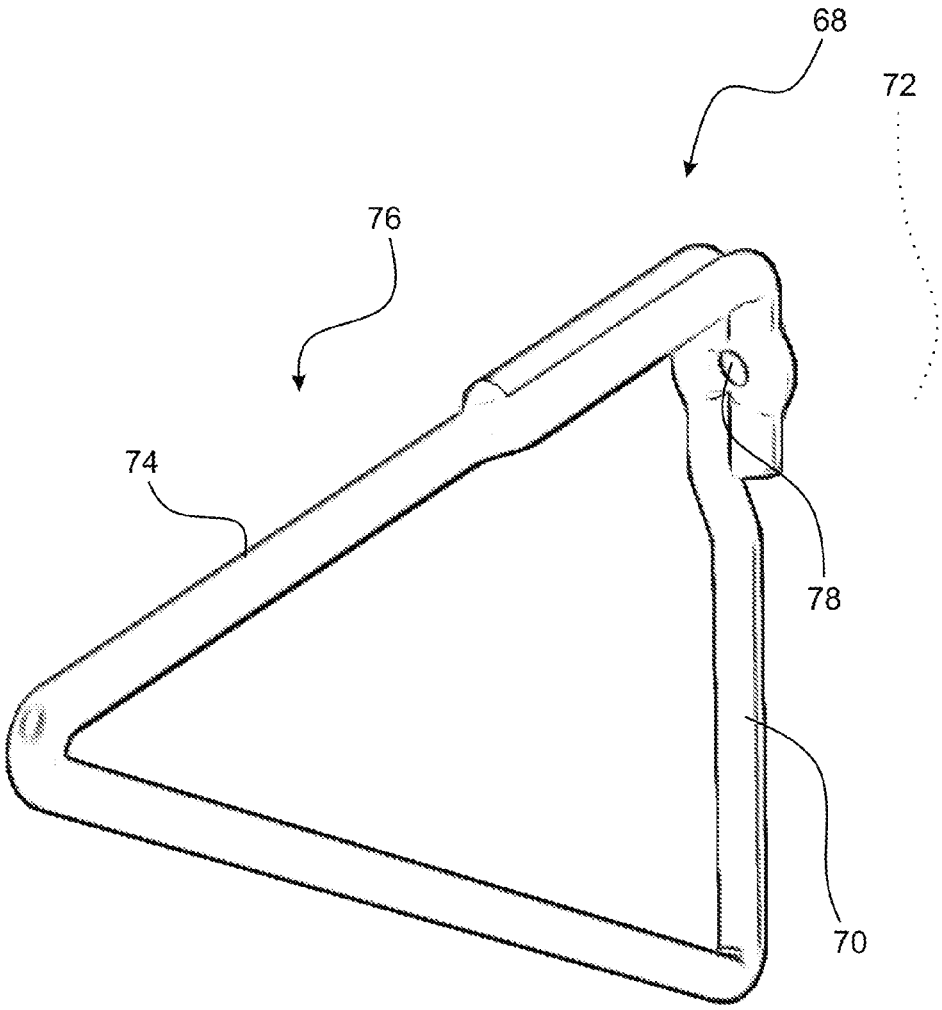
FIG. 12 illustrates a bracket according to a further embodiment.

Referring to FIG. 12 there is shown a bracket 68 according to a further preferred embodiment of the present invention. The bracket 68 comprises a first portion 70 for substantially vertical mounting to a foundation 72 through the facia 26 of the gutter 12. The bracket 68 further includes a second portion 74 for providing a substantially horizontal support 76. As shown in FIG. 12, the first portion 70 and the second portion 74 are formed from a single continuous rod portion that is looped over to provide the first portion with an aperture 78 for receiving a securing bolt. The ability to provide a bracket with an aperture 78 using a single continuous rod portion is considered to be advantageous.

Figure 13A:
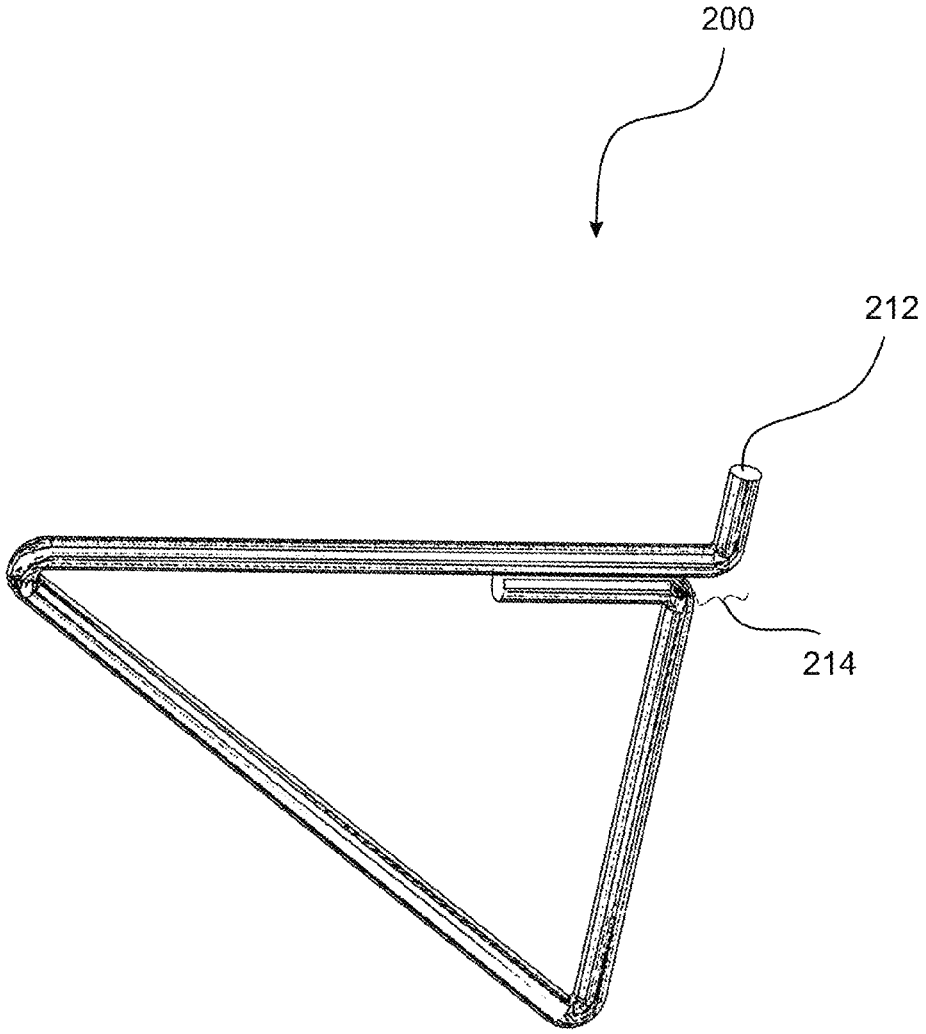
FIGS. 13*a*-13*b* show a bracket according to a further embodiment.
Figure 13B:
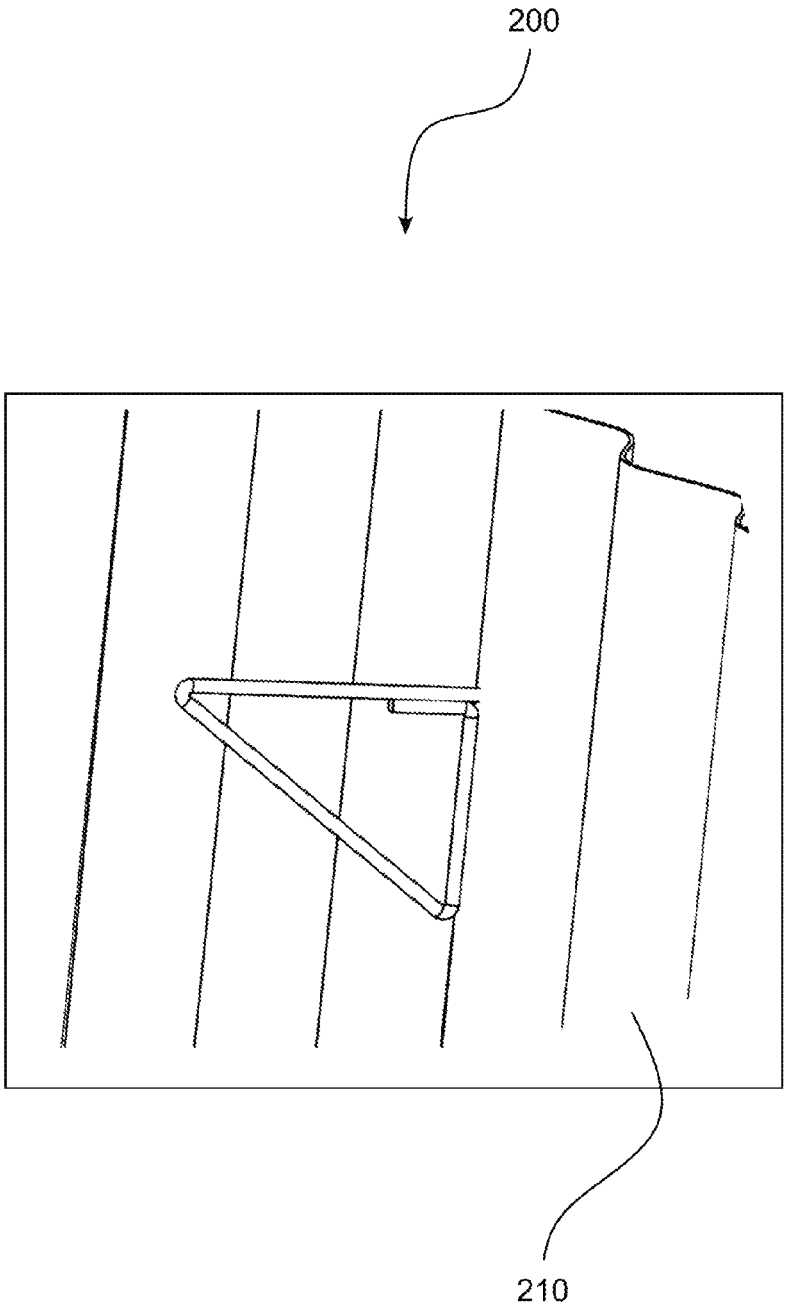

FIGS. 13*a* and 13*b* show another bracket 200. Advantageously with this bracket a hole can be drilled into the face of a wall 210, or otherwise, and the upper end 212 of the bracket fitted therein. A number of the brackets can be placed in series around the outside of the wall to support a length of guttering. The bracket 200 is considered to be particularly useful when attaching to thin material such as roofing iron.

In the case of a facia, the facia would be thicker than the roofing iron. In such a case it is considered that it would be more practicable to use a bracket (such as bracket 68) that screws on. In the case of the bracket 200 there is an offset 214 in the design to accommodate the roofing iron.

The bracket 200 when designed for a different thickness material has a different offset. It is considered that the bracket 200 is a particularly good bracket for use in the situation of attaching to thin metal as it has a good holding force.

Figure 14:
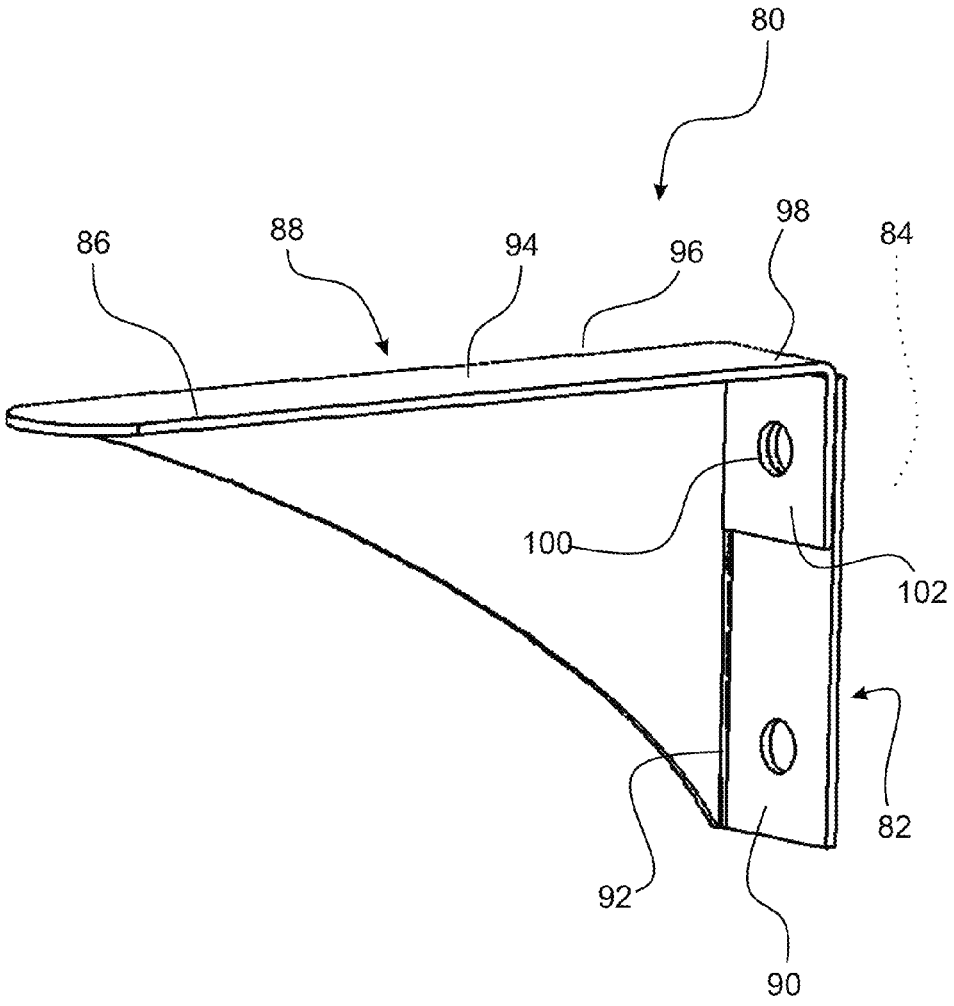
FIG. 14 illustrates a bracket according to a further embodiment.

Referring to FIG. 14 there is shown a bracket 80 according to a further preferred embodiment of the present invention. The bracket 80 comprises a first portion 82 for substantially vertical mounting to a foundation 84 and a second portion 86 for providing a substantially horizontal support 88. The first portion 82 and the second portion 86 are formed from sheet material that is bent to provide the bracket 80.

More particularly the first portion 82 is formed by bending a first flange portion 90 along a first fold line 92. The second portion 86 is formed by bending a second flange portion 94 along a second fold line 96. Advantageously a third fold line 98 is provided on the second flange portion 94 for overlapping the first portion 82. As shown in FIG. 14 the first and second flange portions are overlapped at an opening 100 for receiving a bolt. Fastening a bolt through the opening 100 provides advantageous strength due to the overlapping. The second portion 86 accordingly includes an overlapping portion 102.

Figure 15:
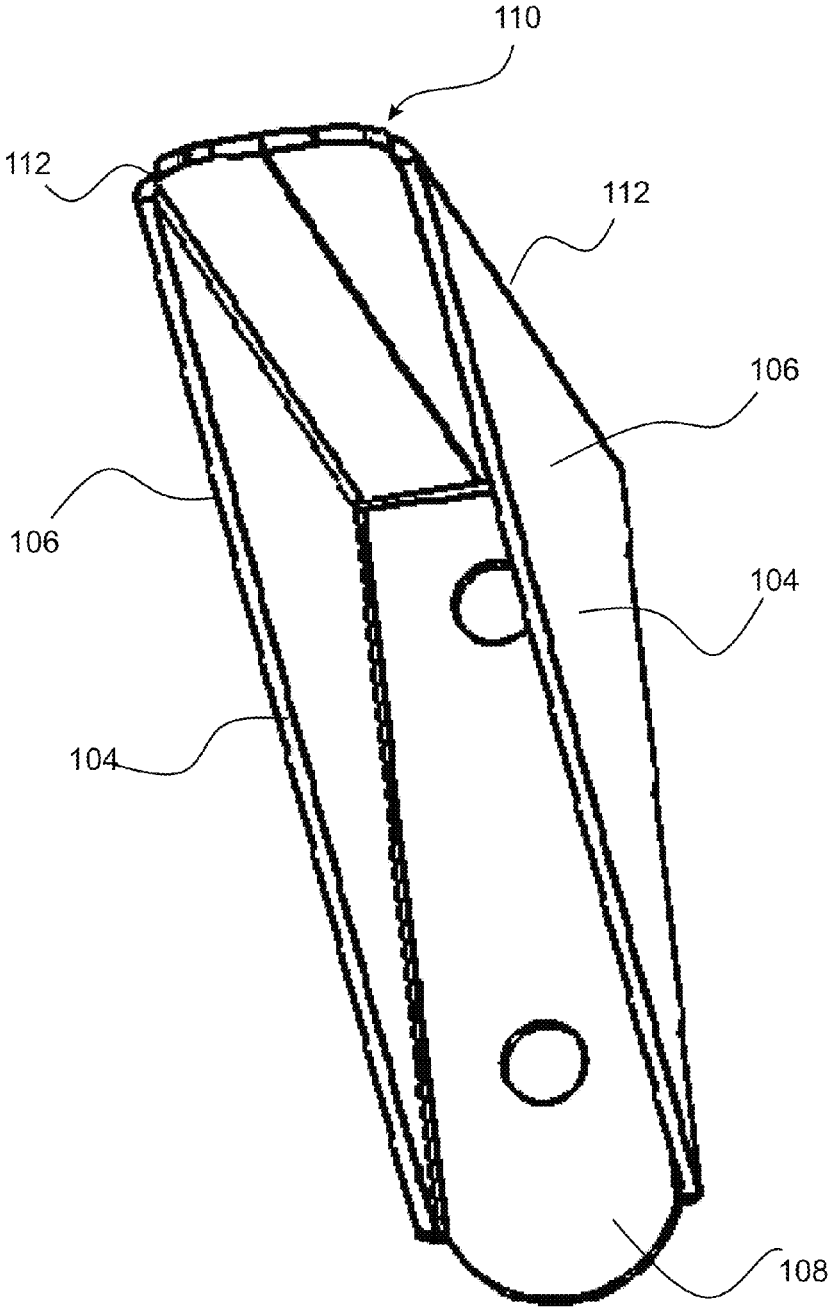
FIG. 15 illustrates an embodiment in which two flange portions are bent to provide two vertical flanges on either side of a vertical support.

FIG. 15 shows an embodiment in which two flange portions 104 are bent to provide two vertical flanges 106 on either side of a vertical support 108. The vertical flanges 106 are further bent to provide a horizontal flange portion 110. The provision of two bends 112 provides advantageous strength.

Figure 16:
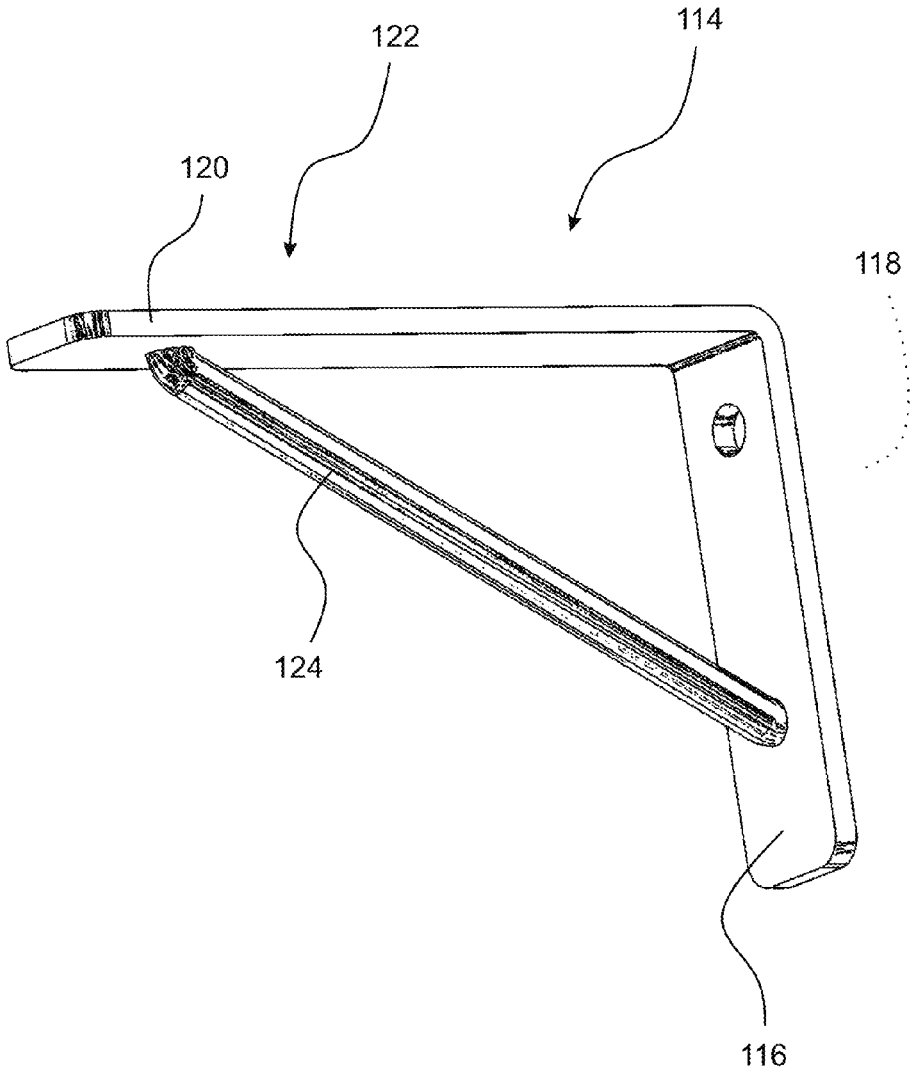
FIG. 16 illustrates a bracket according to a further embodiment.
Figure 17:
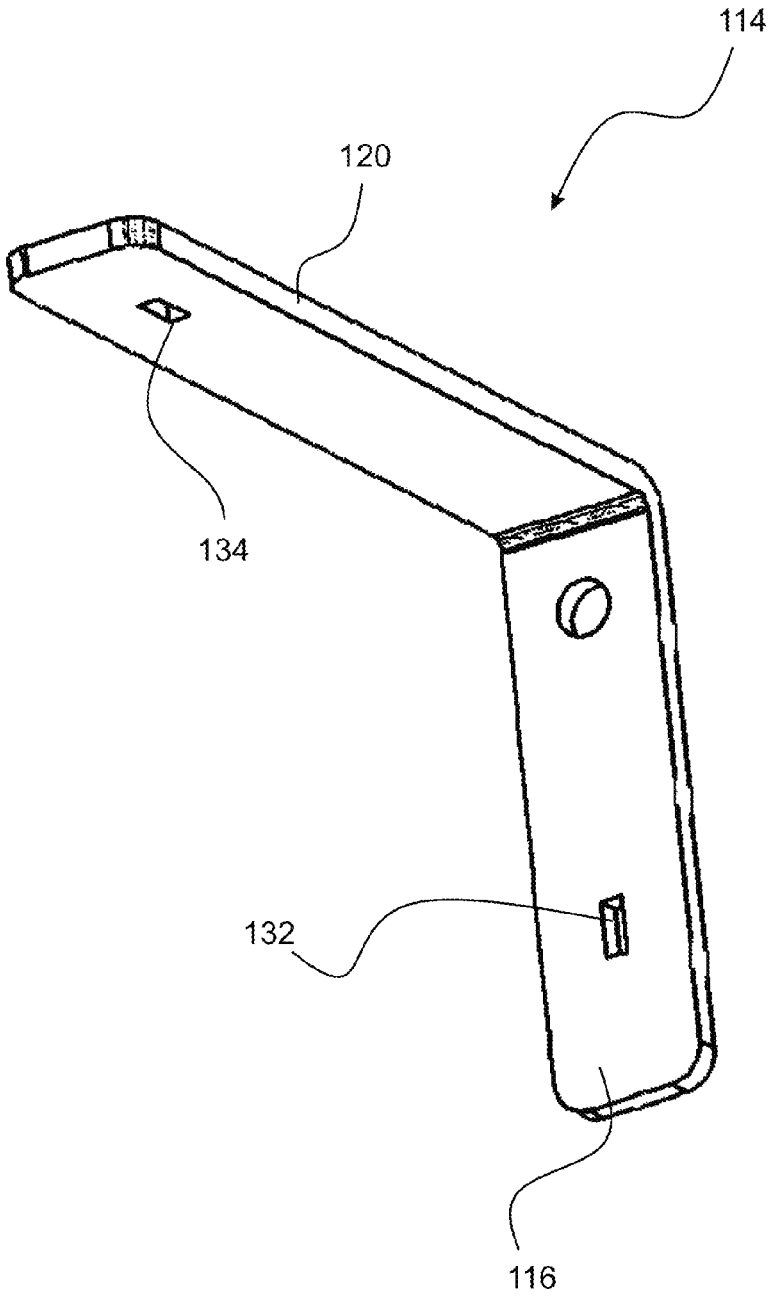
FIG. 17 illustrates a bracket.
Figure 18:
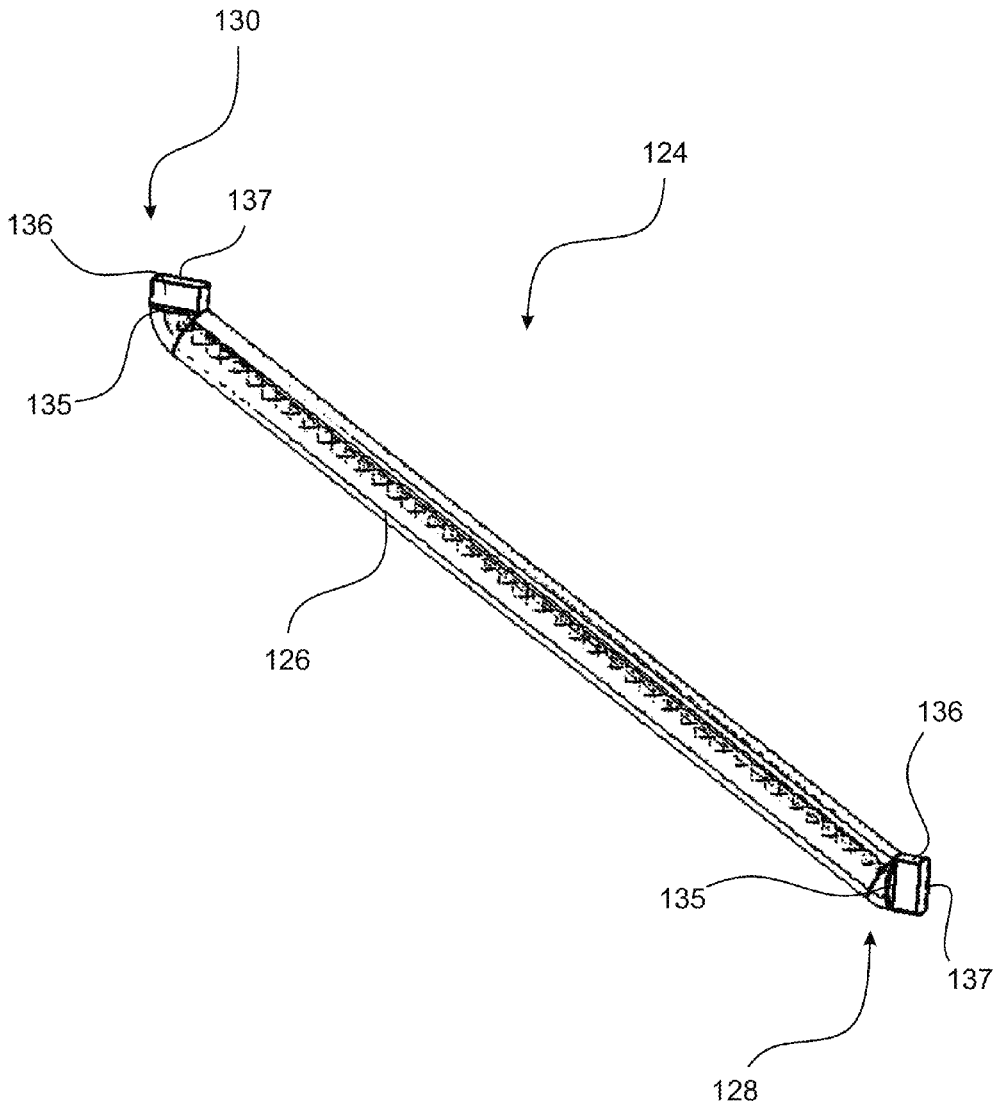
FIG. 18 illustrates a brace portion.

FIGS. 16 to 18 show an embodiment in which a bracket 114 comprises first portion 116 for substantially vertical mounting to a foundation 118 and a second portion 120 for providing a substantially horizontal support 122. In the embodiment a removable brace portion 124 extends between the first portion 116 and the second portion 120 to provide an advantageously removable brace portion.

As shown in FIG. 18 the brace portion 124 includes a body portion 126 having a first end portion 128 and a second opposite end portion 130. The first end portion 128 is adapted to extend through an opening 132 in the first portion 116 and the second end portion 130 is adapted to extend through and opening 134 in the second portion 120. The first end portion 128 and the second end portion 130 include an outward facing abutment surface 135 and an extension 136. The extensions 136 each include distal surfaces 137 adapted to lie flush with the outer surface of the respective first and second portions 116, 120. The removable brace portion may be welded in position.

Figure 19:
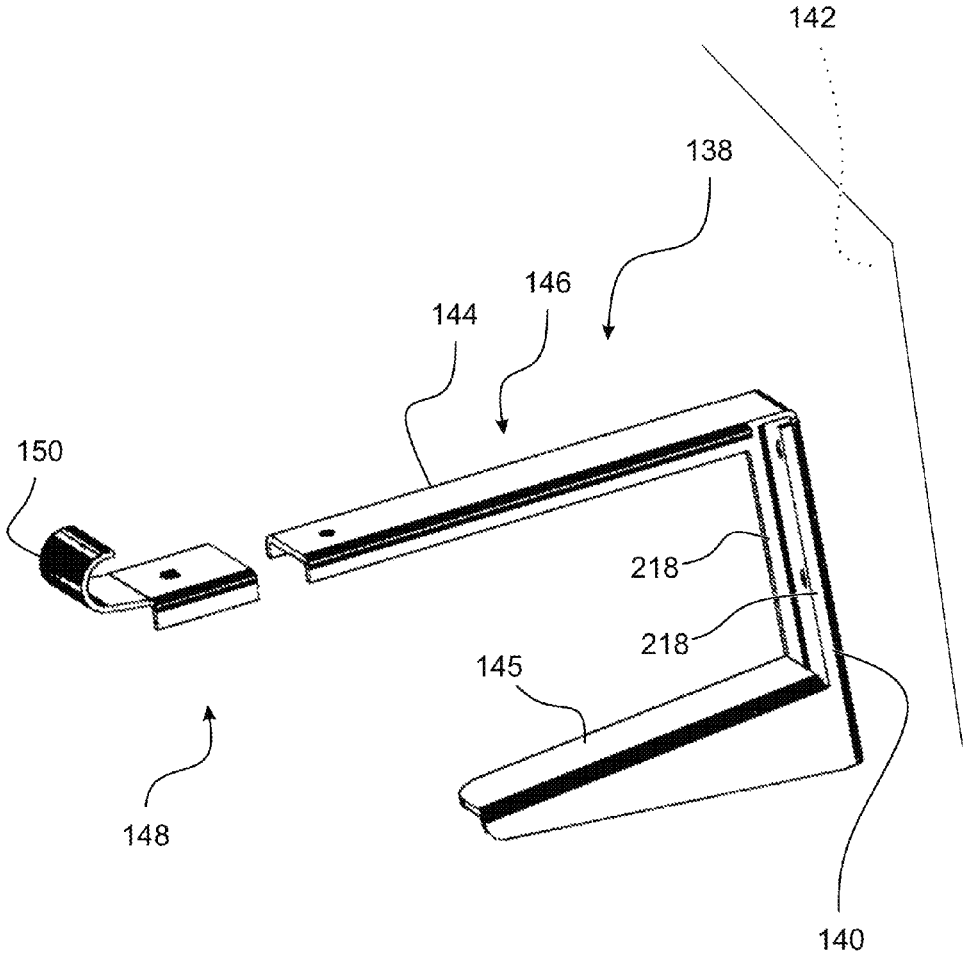
FIG. 19 illustrates a bracket which includes a first portion for substantially vertical mounting to a foundation surface and a second portion extending away from an upper end of the first portion.
Figure 20:
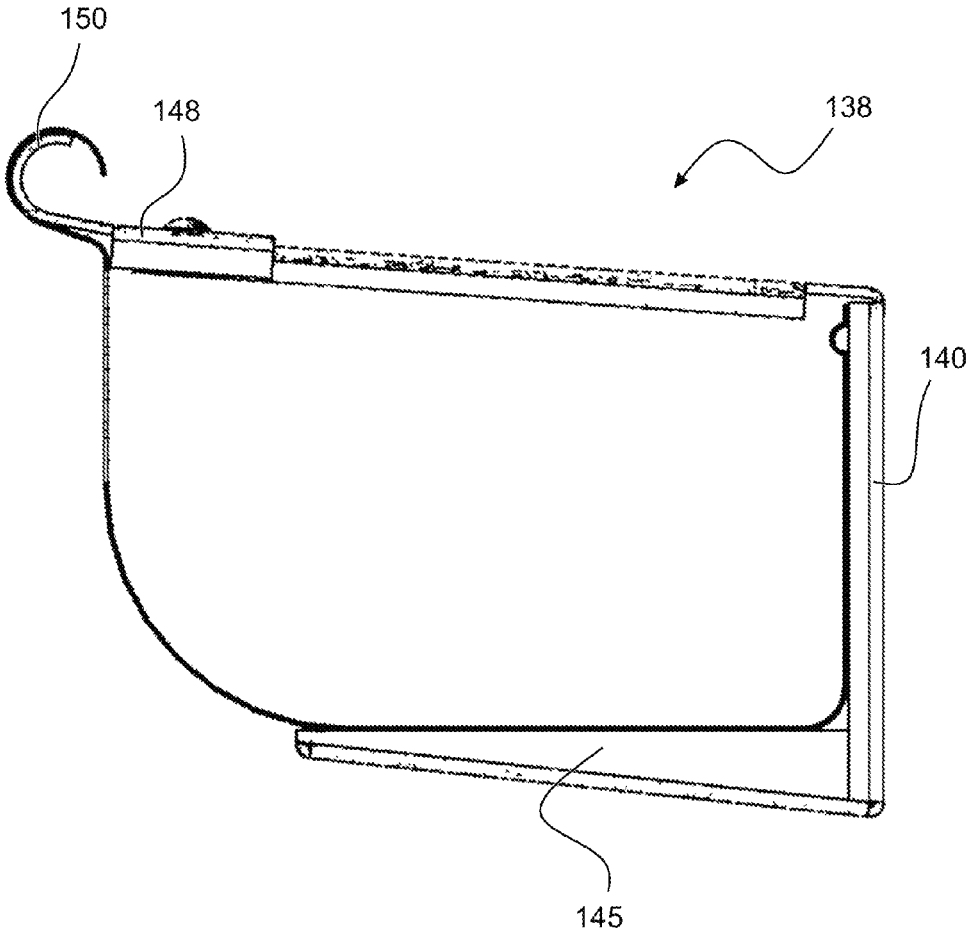
FIG. 20 illustrates a second portion which includes an extension for fitting within the lip of the gutter.

FIG. 19 shows an embodiment in which a bracket 138 includes a first portion 140 for substantially vertical mounting to a foundation surface 142 and a second portion 144 extending away from an upper end of the first portion 140. A third portion 145 is provided for supporting a gutter from below. The second portion 144 includes an extension 148 for fitting within the lip of the gutter to assist with holding the gutter in position, as shown in FIG. 20. The extension 148 is advantageously removable and in other embodiments can be positioned at several locations to hold the gutter in position on the third portion 145. The extension 148 provides an enlarged head portion 150 sized to fit within the circular lip of the gutter.

The reason for the extension 148 is removable to allow a person to install the gutter onto the bracket. Current brackets are all one piece and do not require this because the gutter is installed by engaging the outer lip of the gutter into the hook of the bracket and then swung up into position. The brackets have a small ledge of 10 mm deep to hold the bottom back edge of the gutter or they have a clip mechanism to engage and hold onto the inside top edge of the gutter.

With the present bracket the supporting member 145 prevents installing in this manner. Rather, the gutter is placed on the supporting member 145 and then the extension piece is engaged in the gutter lip, rotated and fastened to the member 144 with a tek screw through the holes provided.

The extension piece 148 could be screwed together at a different location however in this embodiment the brackets are made to match each individual gutter profile that should rarely be needed.

With the currently used brackets the gutter lengths are joined together as much as possible while the gutter is hanging down and then is swung up into position. Installing using the present brackets is considered to be advantageously easier as the gutter is supported in its final position before being joined and attached.

As shown in FIGS. 19 and 20, the bracket 138: (i) incorporates a supporting member that extends underneath the gutter; (ii) the top member has a detachable extension/clip component for securing the gutter to the bracket; and (ii) the design is considered to allow for the easy installation of gutters and provides superior support compared to other brackets currently available.

In addition in this embodiment the member for mounting to a supporting structure 140 is strengthened by having a flange 218 on each side to form a shallow channel that is deep enough to accommodate the head of a tek screw bolt. This also creates a gap between the supported gutter and the facia that it is attached to. This is considered to provide an advantageous gap for overflow.

Furthermore the bracket 138 made from single piece of sheet metal (not including the attaching clip 148).

Figure 21:
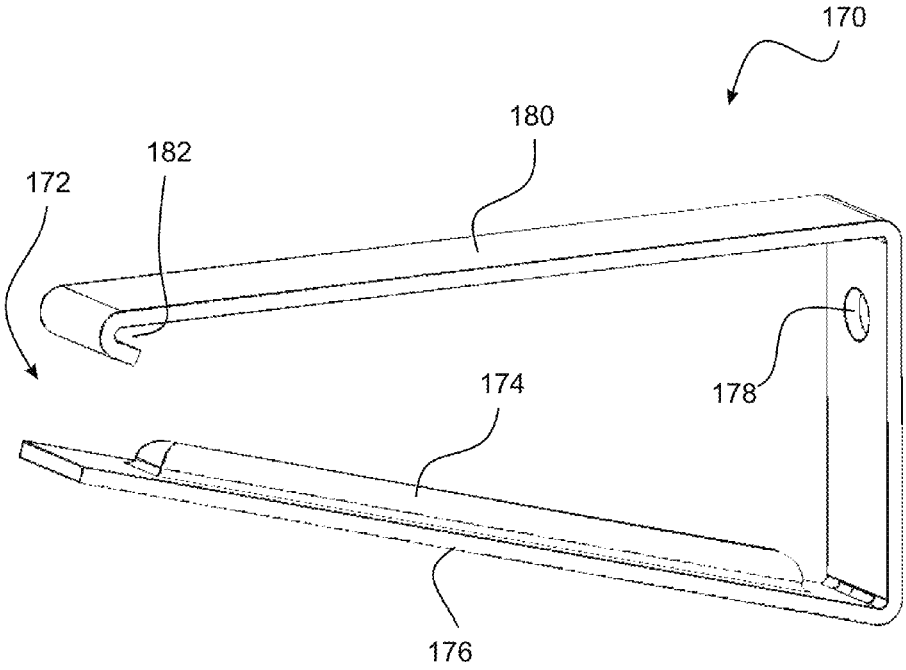
FIGS. 21 and 22 illustrate a further embodiment in the form of a bracket.
Figure 22:
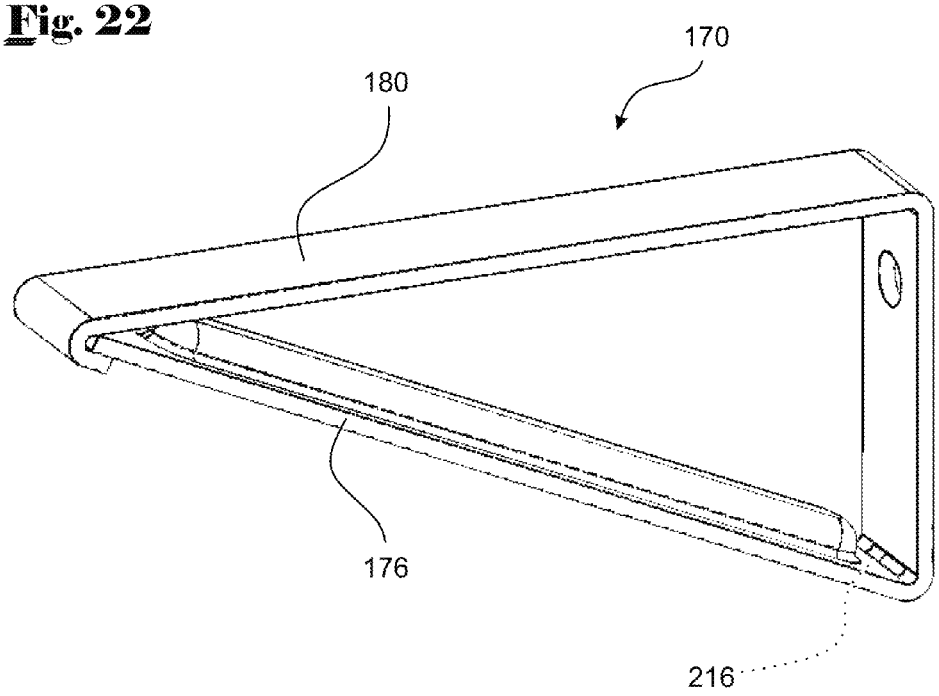

FIGS. 21 and 22 illustrate a further embodiment in the form of a bracket 170. The bracket 170 has a closable end portion 172 and is formed as a continuous single piece. The bracket 170 includes a strengthening portion 174 that advantageously strengthens the lower member 176 that comes under compression in use. The strengthening portion 174 advantageously allows the use of say less than 1.5 mm thickness high tensile strength steel (or possibly thinner or softer material, or larger brackets for large gutters). The bracket 170 is considered to advantageously make efficient use of material with relatively little wastage. It is considered that the bracket 170 can be easily manufactured without a large setup cost.

Furthermore, one feature of the bracket 170 is that that is it can be firstly attached underneath the gutter before it is closed together. This advantageously facilitates the easy insertion of the screw through a hole 178 and into whatever it is attached to, as an extension driver, be it a screw or socket driver, can fit between the open gap, thus allowing it to be square onto the head of the screw. The bracket 170 is sold in the open state, and once securely attached, it is simply a matter of bending up the bottom brace 176 and at the same time springing up the top member 180.

In this case the bottom brace 176 is bent up until the end of the bottom brace clears the end of the top member 180. The top member 180 is then let to spring back into its right angle position and the end of the bottom brace 176 engages into the groove 182 of the top flange. Folding over the end of the top member 180 is considered to be advantageous.

As shown, the hole 178 allows the bolt to pass through, which this design allows to be located near the top of the bracket, which results in it being possible to make the back of the bracket shorter than an equivalent bracket without a brace member. (As the material is much thicker the bolt hole must be further down.) There are two reasons why this is an advantage. First there can be a lack distance between the bottom of a gutter and the edge of the supporting facia board or other member. Secondly they are more aesthetically pleasing and less noticeable if they have less depth.

A slot is preferably positioned at location 216 at the bend of the brace section to facilitate it bending at that spot instead of it flexing or bending along the brace or back section when it is forced up.

As would be apparent there are to different types of brackets disclosed herein. The first type are those that are used to provide extra support under the gutters. These are all right-angle brackets secured under the gutters. The second type are a replacement for the currently used brackets. These would be used when installing a new gutter and do not require the additional strengthening brackets.

It is considered that current brackets used in Australia have two major design defects. Firstly, they do not positively resist downward force. As they have no bracing component to prevent the gutters from sagging the more weight of material in the gutter the more the gutter sags.

Secondly, the back portion of the bracket where they are mounted to the facia board is flat. There is no provision for the head of a bolt as they were designed to be used with flat headed nails. These often work their way out over time.

Whilst tek screws are now usually used but even the minimal head types still protrude more than the flat headed nails. This does not allow the gutter to sit in the bracket correctly and it precludes the use of tek screws with socket heads.

Many of these brackets only have one hole at the top which is offset to one side due to the design of the top member of the bracket. This makes them difficult to satisfactorily attach to roofing iron clad walls or other situations where the mounting surface is not flat or as wide as the bracket.

Preferred embodiments of the present invention are considered to provide a number of systems and methods including those that advantageously:

(i) Allow for retrofitting in gutters having internal brackets.
(ii) Allow for installation in gutters where the roof partly extends over the gutters.
(iii) Assist with preventing leaves and other debris from collecting in gutters.
(iv) Will generally be durable and robust.
(v) Allow for good drainage whilst limiting the accumulation of leaves and other debris.
(vi) Accommodate a variety of differently shaped and sized gutters.
(vii) Accommodate a variety of different roof types and their profiles.
(viii) Accommodate a variety of different and variable gutter to roof alignments.
(ix) Utilise several readily available component parts to provide a useful roof guttering system.
(x) Are cost competitive with other methods both in materials and installation.
(xi) Will generally have a low maintenance requirement.
(xii) Will generally prevent the entry of vermin into the roof cavity of buildings.
(xiii) Will generally prevent the entry of bush fire embers into the roof cavity of buildings.
(xiv) Will generally provide good quality filtered water for storage tanks.

The brackets are considered to provide further embodiments of the present invention.

It is to be recognised that various alterations and equivalent forms may be provided without departing from the spirit and scope of the present invention. This includes modifications within the scope of the appended claims along with all modifications, alternative constructions and equivalents. There is no intention to limit the present invention to the specific embodiments shown in the drawings. The present invention is to be construed beneficially to the applicant and the invention given its full scope.

In the present specification, the presence of particular features does not preclude the existence of further features. The words 'comprising', 'including' and 'having' are to be construed in an inclusive rather than an exclusive sense.

What is claimed is:

1. A filter system for existing roof gutters, comprising:
a) a drainage pipe for being positioned within and extending along a roof gutter;
b) a roof rain gutter component for connection to said drainage pipe and being positioned over a drop outlet of said roof gutter;
c) a coarse heavy filler material for being placed on top of said drainage pipe and said gutter component within said roof gutter for allowing the passage of rain water; and
d) a support bracket to support the weight of said coarse heavy filler material;
e) said gutter component being adapted to surround the drop outlet to assist with preventing the passage of said coarse heavy filler material through the drop outlet
whereby said coarse heavy filler material adapted to substantially fill the gutter to create an effective rainwater filter, with said drainage pipe and said gutter component creating an unobscured passage within said heavy filler material for rainwater to flow through to the drop outlet, with said support brackets for positioning under the gutter to securely support the weight of said coarse heavy filler material.

2. The roof rain gutter filter system of claim 1 wherein said drainage pipe is slotted corrugated drainage pipe.

3. The roof rain gutter filter system of claim 1 wherein said drainage pipe is of a size that does not substantially fill the gutter to provide necessary space for the coarse heavy filler material.

4. The roof rain gutter filter system of claim 1 wherein said drainage pipe is of a size so as to fit under internal gutter brackets.

5. The roof rain gutter filter system of claim 1 wherein said coarse heavy filler material is crushed stone or river pebbles.

6. A roof rain gutter component structured to be a fluid port between a drainage pipe positioned within and extending along a gutter and a drop outlet of the gutter, the component comprising:
a body composed of a cylindrical tube, the cylindrical tube having open ends, the cylindrical tube being sized to facilitate the insertion of a drainage pipe within the open ends, the cylindrical tube having a mid-section between the open ends, the mid-section having an extension portion extending from the tube, the extension portion having an opening for surrounding a drop outlet of a gutter, the opening having an outside edge that is the base of the body that is adapted to sit on an internal floor of a gutter, the outside edge being on a plane substantially tangential to the outside circumference of the cylindrical tube so that the outside edge of the opening and a portion of the outside cylindrical tube circumference is adapted to rest relatively flush on the portion of the gutter that surrounds the gutter drop outlet.

7. The roof rain gutter component of claim 6 wherein said mid-section extension portion has a substantially triangular cross sectional shape.

8. The roof rain gutter component of claim 7 wherein said opening in the tube for surrounding the gutter drop outlet has a flange therearound.

9. The roof rain gutter component of claim 8 wherein said flange has a plurality of drainage vents on its underside.

10. The roof rain gutter component of claim 8 wherein said flange has a plurality of protrusions on its underside to provide a positive gap for the passage of water underneath the flange.

11. A method of providing a filter system for existing roof gutters, comprising:

(a) positioning a drainage pipe within a gutter;

(b) positioning a rain guttering component over a drop outlet of said gutter and connecting to said drainage pipe;

(c) positioning and securing support brackets below said gutter; and (d) substantially filling said gutter with a coarse heavy filler material.

* * * * *